US011697075B2

(12) United States Patent
Brennan et al.

(10) Patent No.: US 11,697,075 B2
(45) Date of Patent: Jul. 11, 2023

(54) TOY CAR STORAGE DEVICE

(71) Applicant: 3 Castles Pty. Ltd., Banyo (AU)

(72) Inventors: Conor John Brennan, Banyo (AU); David A. White, Easthampton, MA (US)

(73) Assignee: 3 Castles Pty. Ltd.

( * ) Notice: Subject to any disclaimer, the term of this patent is extended or adjusted under 35 U.S.C. 154(b) by 205 days.

(21) Appl. No.: 17/209,768

(22) Filed: Mar. 23, 2021

(65) Prior Publication Data

US 2022/0305397 A1 Sep. 29, 2022

(51) Int. Cl.
*A63H 17/44* (2006.01)

(52) U.S. Cl.
CPC ..... *A63H 17/44* (2013.01)

(58) Field of Classification Search
CPC ..... A63H 17/44
See application file for complete search history.

(56) References Cited

U.S. PATENT DOCUMENTS 2,100,421 A * 11/1937 Wupper ..... A63F 3/00574 235/90
3,905,602 A * 9/1975 Madonna, Jr. ..... A63F 3/00 273/249
4,043,056 A * 8/1977 Savage ..... G09B 1/14 434/96
D379,481 S * 5/1997 Johnson ..... D21/558
D380,117 S * 6/1997 Smith ..... D6/571
D420,535 S * 2/2000 Klock ..... D6/675.4
D431,734 S * 10/2000 Edgell ..... D6/563
6,167,680 B1 * 1/2001 Horn ..... B65D 25/04 220/4.23

(Continued)

FOREIGN PATENT DOCUMENTS

CN 206773953 U * 12/2017

OTHER PUBLICATIONS

Translation CN 206773953U (Year: 2017).*

*Primary Examiner* — Eugene L Kim
*Assistant Examiner* — Alyssa M Hylinski
(74) *Attorney, Agent, or Firm* — Eric Karich; Karich & Associates

(57) ABSTRACT

A toy car storage device for storing toy cars has a storage body that is defined by a top edge, a bottom edge, a front edge, and a rear edge. A plurality of storage recesses is formed in the storage body, each of the storage recesses being sized and shaped to receive one of the toy cars. A plate frame is mounted adjacent the bottom edge of the storage body and has an upper ridge and a lower ridge which together form a plate receiving space therebetween. A plurality of plates may be slidably mounted in the plate receiving space and frictionally held between the upper and lower ridges of the plate frame. First and second slots are formed in the bottom edge, between the plate frame and the front edge of the storage body, for interlocking with first and second stabilizer stands each having interlocking portions and a pair of laterally extending legs. When interlocked, these function to support the storage body in an upright position, and the first and second interlocking portions of the first and second stabilizers each extend beyond the lower ridge of the plate frame to block any of the plates from sliding out of the plate receiving space.

18 Claims, 3 Drawing Sheets

(56) References Cited

U.S. PATENT DOCUMENTS

| | | | | |
|---|---|---|---|---|
| 6,178,679 | B1 * | 1/2001 | Dundorf | G09F 7/10 40/5 |
| 6,447,079 | B1 * | 9/2002 | Irwin | A47G 1/12 312/118 |
| 6,467,632 | B1 * | 10/2002 | Guillot | A47F 11/10 211/13.1 |
| 8,808,050 | B2 * | 8/2014 | Goldmeier | G09B 25/04 446/105 |
| D950,987 | S * | 5/2022 | Brennan | D6/674 |
| 2003/0033745 | A1 * | 2/2003 | Ribaudo | B44C 5/005 40/800 |
| 2004/0031700 | A1 * | 2/2004 | Hanshaw | A47G 1/12 206/0.8 |
| 2009/0127409 | A1 * | 5/2009 | Vihauer | G09F 19/00 248/176.1 |
| 2012/0088429 | A1 * | 4/2012 | Goldmeier | G09B 19/00 446/82 |

* cited by examiner

TOY CAR STORAGE DEVICE

BACKGROUND OF THE INVENTION

Field of the Invention

This invention relates generally to toy car storage devices, and more particularly to a toy car storage device having stabilizer stands for standing upright.

Description of Related Art

Toy car storage devices are typically designed to be mounted on a wall, and may include various ornamental designs for market appeal. However, there exists a need for a toy car storage device that may be optionally stood upright or mounted on a wall. Furthermore, it is desirable to have a product that may be personalized, while standard toy car storage devices are typically customizable only through made-to-order services.

The prior art teaches toy car storage devices. However, the prior art does not teach a toy car storage device that is capable of either wall mounting or standing upright, and that further includes a structure for personalizing the product. The present invention fulfills these needs and provides further advantages as described in the following summary.

SUMMARY OF THE INVENTION

The present invention teaches certain benefits in construction and use which give rise to the objectives described below.

The present invention provides a toy car storage device for storing toy cars. The toy car storage device comprises a storage body that is defined by a top edge, a bottom edge, a front edge, and a rear edge. A plurality of storage recesses is formed in the storage body, each of the storage recesses being sized and shaped to receive one of the toy cars. A plate frame is mounted adjacent the bottom edge of the storage body and has an upper ridge and a lower ridge which together form a plate receiving space therebetween. A plurality of plates may be slidably mounted in the plate receiving space frictionally held between the upper and lower ridges of the plate frame. A first slot is formed in the bottom edge, between the plate frame and the front edge of the storage body, the first slot extending upwardly into the storage body beyond the lower ridge of the plate frame. A second slot is formed in the bottom edge, between the plate frame and the rear edge of the storage body, the second slot extending upwardly into the storage body beyond the lower ridge of the plate frame. A first stabilizer stand has a first interlocking portion, and a pair of laterally extending legs, the interlocking portion interlocking with the first slot. A second stabilizer stand has a second interlocking portion, and a pair of laterally extending legs, the second interlocking portion interlocking with the second slot. The first and second stabilizers, when interlocked with the first and second slots, function to support the storage body in an upright position, and the first and second interlocking portion of the first and second stabilizers extend beyond the lower ridge of the plate frame to block any of the plates from sliding out of the plate receiving space between the upper and lower ridges.

A primary objective of the present invention is to provide a toy car storage device having advantages not taught by the prior art.

Another objective is to provide a toy car storage device having first and second stabilizer stands for standing the device upright.

A further objective is to provide a toy car storage device having a plate frame for personalizing the device.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a toy car storage device for storing toy cars.

Figure 1:
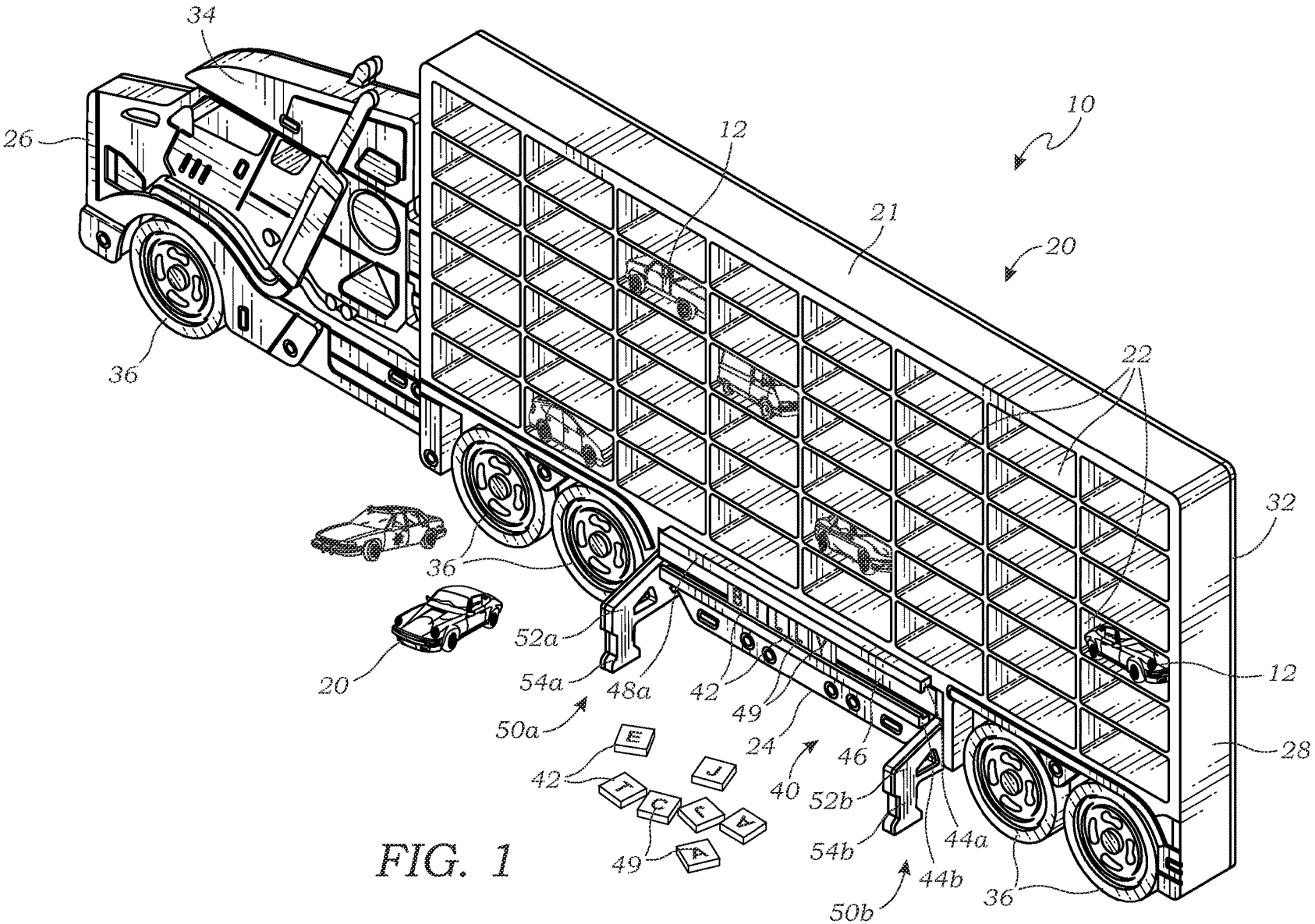
FIG. 1 is a top perspective view of a toy car storage device according to one embodiment of the present invention.
Figure 2:
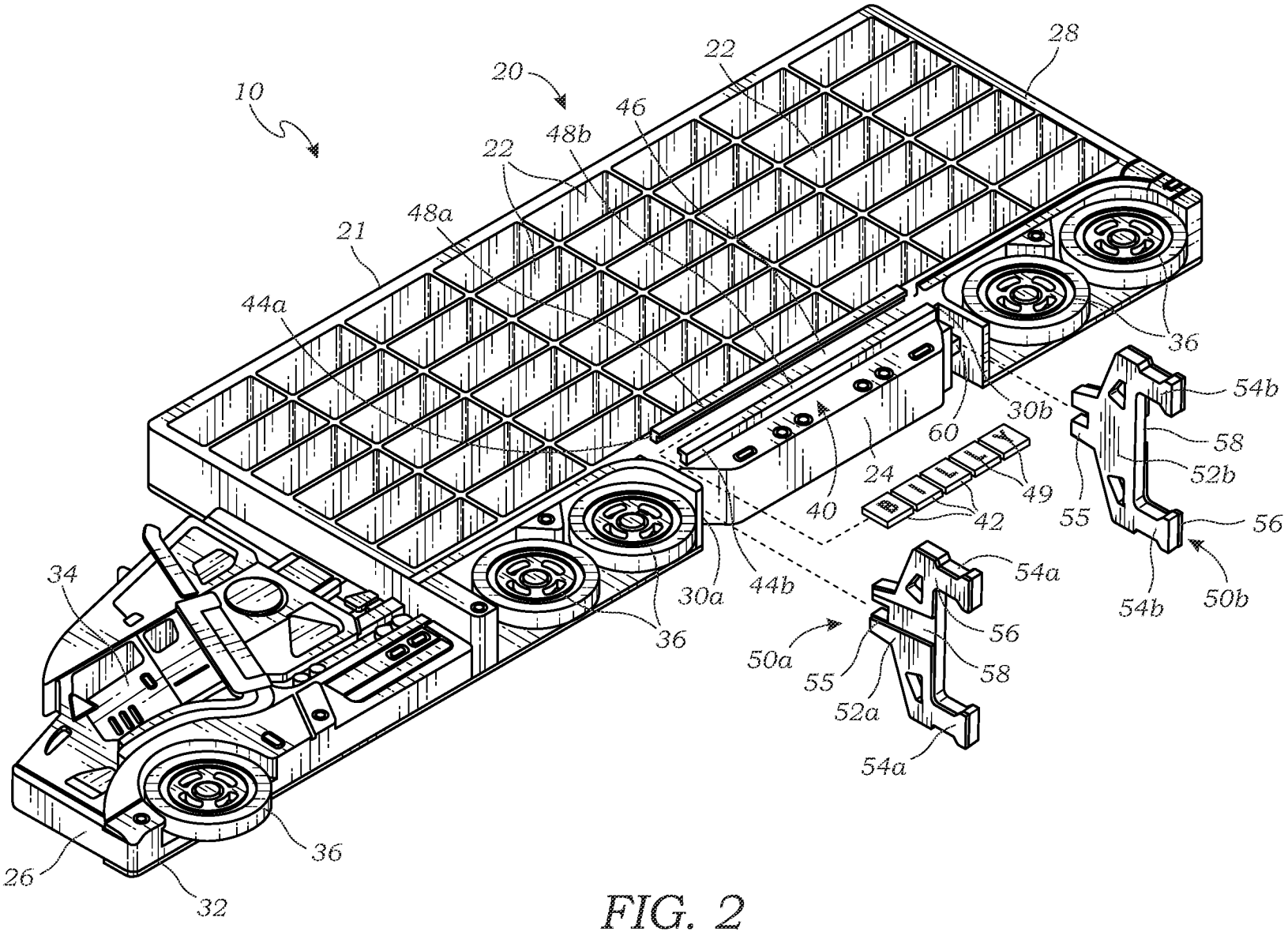
FIG. 2 is an exploded bottom perspective view thereof.

FIG. 1 is a top perspective view of a toy car storage device 10 according to one embodiment of the present invention, and FIG. 2 is an exploded bottom perspective view thereof. As shown in FIGS. 1-2, the toy car storage device 10 includes a storage body 20 having a plurality of storage recesses 22 for containing toy cars 12, a plate frame 40 mounted to the storage body 20 for displaying a plurality of plates 42, and first and second stabilizer stands 50*a* and 50*b* for supporting the storage body 20 in an upright position, each component being discussed in greater detail below.

The storage body 20 is defined by a top edge 21, a bottom edge 24, a front edge 26, and a rear edge 58. The plurality of storage recesses 22 is formed in the storage body 20, each of the storage recesses 22 being sized and shaped to receive one of the toy cars 12. In this embodiment, there are 48 storage recesses 22 in a 6×8 arrangement, but any number of storage recesses 22 may be provided, in any suitable arrangement formed in the generally rectangular storage body 20. In this embodiment, the storage recesses 22 are each also generally rectangular in shape, but in other embodiments may be any shape suitable for containing each of the toy cars 12 (e.g., irregularly shaped, triangular, having rounded edges or many sides, etc.). Further, first and second slots are formed in the bottom edge 24 of the storage body 20, between the plate frame 40 and the front edge 26 of the storage body 20, each slot extending upwardly into the storage body 20 and being adapted to receive the first and second stabilizer stands 50*a* and 50*b*, respectively, best shown in FIGS. 2-3 and discussed in greater detail below.

As shown in the figures, the storage body 20 may also include a back panel 32, providing a backing for the plurality of storage recesses 22. In some embodiments, the back panel 32 includes holes for receiving a mounting structure for attachment to a wall (not shown). The back panel 32 may be integrally formed with the rest of the storage body 20, or it may be attached separately via any means known in the art (e.g., via an adhesive, screws, or any other form of attachment). In this embodiment, the back panel 32 further extends past the storage recesses 22 of the storage body 20 to provide a backing for ornamental features of the device 10, in this embodiment being the likeness of a two-dimensional semi-truck cab 34 adjacent the front edge 26 of the storage body 20, and a set of wheels 36 adjacent the bottom edge 24 on either side of the plate frame 40, the plate frame 40 being discussed in greater detail below. Other ornamental features may be applied to the back panel 32 or be otherwise attached to the storage body 20, e.g., a different type of vehicle likeness, household object, etc., provided it is within the scope of the claims of the present invention. Alternatively, the storage body 20 may be provided without the back panel 32, with ornamental features attached via another means (e.g., hingeable or fixed attachment to the edges of the storage body 20, etc.), or without ornamental features.

The plate frame 40 is mounted adjacent the bottom edge 24 of the storage body 20 and has an upper ridge 44*a* and a lower ridge 44*b* which together form a plate receiving space 46 therebetween. The plurality of plates 42 may be slidably mounted in the plate receiving space 46 frictionally held between the upper and lower ridges 44*a* and 44*b* of the plate frame 40. The upper and lower ridges 44*a* and 44*b* are spaced a distance D1 (shown in FIG. 3) that is greater than the height of each of the plurality of plates 42. In this embodiment, the upper ridge 44*a* has an upper flange 48*a* that extends downwardly from the upper ridge 44*a*, and the lower ridge 44*b* has a lower flange 48*b* that extends upwardly from the lower ridge 44*b*, such that each of the plurality of plates 42 are prevented from falling forward out of the plate receiving space 46 after being mounted laterally.

In this embodiment, the plurality of plates 42 each include indicia 49 that is visible when the plates 42 are mounted in the plate receiving space 46. The indicia 49 of FIGS. 1-2 is in the form of English letters that may be arranged to spell a word (or in this case, a name), but any language may also be used, or any numbers, symbols, icons, drawings, or any other desired indicia. The indicia 49 may be directly printed onto the plurality of plates 42, or it may be engraved, etched, cut, or otherwise applied using any method known to those skilled in the art.

The first and second stabilizers 50*a* and 50*b*, when interlocked with the first and second slots 30*a* and 30*b*, function to support the storage body 20 in an upright position (FIG. 1). As shown in FIG. 2, the first and second stabilizer stands 50*a* and 50*b* may be removably attached to the storage body 20 of the device 10. The first stabilizer stand 50*a* has a first interlocking portion 52*a* and a pair of laterally extending legs 54*a*, the first interlocking portion 52*a* interlocking with the first slot 30*a* of the storage body 20. The second stabilizer stand 50*b* has a second interlocking portion 52*b* and a pair of laterally extending legs 54*b*, the second interlocking portion 52*b* interlocking with the second slot 30*b* of the storage body 20. The first and second interlocking portions 52*a* and 52*b* are adapted to engage with the first and second slots 30*a* and 30*b* of the storage body 20 such that, when interlocked and in an upright position, the first and second stabilizer stands 50*a* and 50*b* are prevented from disengagement with the storage body 20. The structure of the first and second interlocking portions 52*a* and 52*b* is discussed in greater detail below. Detail of the first and second slots 30*a* and 30*b* is shown in FIG. 3 and discussed below.

Figure 3:
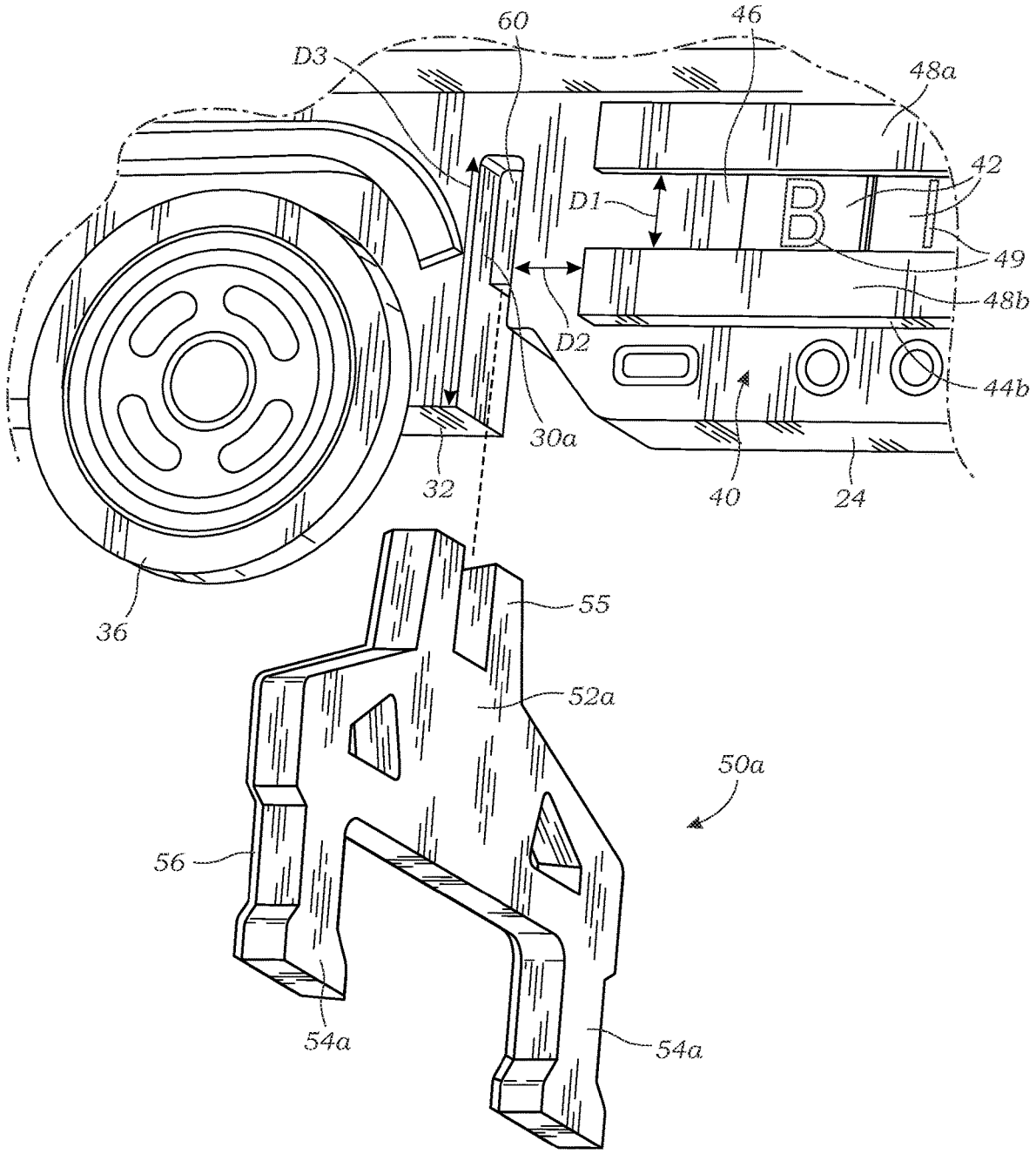
FIG. 3 is an up-close exploded view of a stabilizer stand and a slot of the toy car storage device.

FIG. 3 is an up-close exploded view of the first stabilizer 50*a* and the first slot 30*a* of the toy car storage device 10. As shown in FIG. 3 and discussed above, D1 illustrates the space between the upper and lower ridges 44*a* and 44*b*, which is greater than the height of the plates 42.

As shown in FIG. 3, each slot 30*a* and 30*b* is spaced a distance D2 from the plate frame 40. In some embodiments, D2 may be small enough to block the plates 42 from sliding out of the plate receiving space 46 between the upper and lower ridges 44*a* and 44*b* when the stands 50*a* and 50*b* are engaged with the slots. However, in other embodiments, D2 may be great enough to allow the plates 42 to slide out of the frame 40 laterally.

Further, each slot 30*a* and 30*b* extends upwardly into the storage body 20 beyond the lower ridge 44*b* of the plate frame 40 a distance D4. In some embodiments, D4 extends past the lower ridge 44*b* of the plate frame 40, but terminates before the upper ridge 44*a*. However, in other embodiments, D4 extends to or past the upper ridge 44*a*.

In this embodiment, each slot 30*a* and 30*b* includes an inner shaft 60 that corresponds to a "U" shaped portion 55 of the first and second interlocking portions 52*a* and 52*b*. In an interlocked position, the "U" shaped portion 55 is inside of the slot 30*a* or 30*b* and surrounds the shaft 60. The first and second interlocking portions 52*a* and 52*b* each further comprise a first face 56 having a cutout 58 (best shown in FIG. 2). In an interlocked position, the first face 56 is outside of the slot 30*a* or 30*b* on either side of the cutout 58. The combination of the "U" shaped portion 55 and the first face 56 prevents the storage body 20 from sliding horizontally out of the first and second stabilizer stands 50*a* and 50*b* in an upright position.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A toy car storage device for storing toy cars, the toy car storage device comprising:

a storage body;

a plurality of storage recesses formed in the storage body, each of the storage recesses being sized and shaped to receive one of the toy cars;

a plate frame mounted adjacent a bottom edge of the storage body, in a middle of the storage body, the plate frame having an upper ridge and a lower ridge which together form a plate receiving space therebetween, so that a plurality of plates may be slidably mounted in the plate receiving space between the upper and lower ridges of the plate frame;

first and second slots each formed in the bottom edge of the storage body on either side of the plate frame, each of the first and second slots extending upwardly into the storage body beyond the lower ridge of the plate frame;

a first stabilizer stand having a first interlocking portion, and a pair of laterally extending legs, the interlocking portion interlocking with the first slot;

a second stabilizer stand having a second interlocking portion, and a pair of laterally extending legs, the second interlocking portion interlocking with the second slot;

wherein the first and second stabilizers, when interlocked with the first and second slots, function to support the storage body in an upright position, and the first and second interlocking portion of the first and second stabilizers extend beyond the lower ridge of the plate frame; and wherein the first and second slots are each positioned a distance from the plate frame, the distance being small enough so that the plates slidably mounted in the plate receiving space are blocked by the first and second stabilizer stands and cannot be removed from the plate receiving space when the first and second stabilizer stands are mounted in the first and second slots, respectively.

2. The toy car storage device of claim 1, wherein each of the first and second slots includes an inner shaft that corresponds to a "U" shaped portion of the first and second interlocking portions.

3. The toy car storage device of claim 2, wherein the first and second interlocking portions each further comprise a first face having a cutout, and wherein the first face is outside of the slot on either side of the cutout when interlocked.

4. The toy car storage device of claim 1, wherein the upper ridge has an upper flange that extends downwardly from the upper ridge, and the lower ridge has a lower flange that extends upwardly from the lower ridge, such that each of the plurality of plates are prevented from falling forward out of the plate frame after being mounted laterally.

5. The toy car storage device of claim 1, the plurality of plates each include indicia that is visible when the plates are mounted in the plate receiving space.

6. The toy car storage device of claim 5, wherein the indicia is in the form of letters.

7. The toy car storage device of claim 5, wherein the indicia is engraved onto each of the plurality of plates.

8. The toy car storage device of claim 1, wherein the upper and lower ridges are spaced a distance that is approximately equal to or greater than the height of each of the plurality of plates.

9. The toy car storage device of claim 1, further comprising a back panel attached to the storage body that provides a backing for the plurality of storage recesses.

10. A toy car storage device for storing toy cars, the toy car storage device comprising:

a storage body that is defined by a top edge, a bottom edge, a front edge, and a rear edge;

a plurality of wheels adjacent the bottom edge, some of the wheels being adjacent the front edge, and some of the wheels being adjacent the rear edge;

a plurality of storage recesses formed in the storage body, each of the storage recesses being sized and shaped to receive one of the toy cars;

a plate frame mounted adjacent the bottom edge of the storage body, the plate frame having an upper ridge and a lower ridge which together form a plate receiving space therebetween, so that a plurality of plates may be slidably mounted in the plate receiving space frictionally held between the upper and lower ridges of the plate frame;

first and second slots each formed in the bottom edge, between the plate frame and the front edge of the storage body, each slot extending upwardly into the storage body beyond the lower ridge of the plate frame;

a first stabilizer stand having a first interlocking portion, and a pair of laterally extending legs, the interlocking portion interlocking with the first slot;

a second stabilizer stand having a second interlocking portion, and a pair of laterally extending legs, the second interlocking portion interlocking with the second slot;

wherein the first and second stabilizers, when interlocked with the first and second slots, function to support the storage body in an upright position, and the first and second interlocking portion of the first and second stabilizers extend beyond the lower ridge of the plate frame to block any of the plates from sliding out of the plate receiving space between the upper and lower ridges; and wherein the first and second slots are each positioned between the wheels adjacent the front edge, and the wheels adjacent the rear edge, and the first and second slots are positioned a distance from the plate frame, the distance being small enough so that the plates slidably mounted in the plate receiving space are blocked by the first and second stabilizer stands and cannot be removed from the plate receiving space when the first and second stabilizer stands are mounted in the first and second slots, respectively.

11. The toy car storage device of claim 10, wherein each of the first and second slots includes an inner shaft that corresponds to a "U" shaped portion of the first and second interlocking portions.

12. The toy car storage device of claim 11, wherein the first and second interlocking portions each further comprise a first face having a cutout, and wherein the first face is outside of the slot on either side of the cutout when interlocked.

13. The toy car storage device of claim 10, wherein the upper ridge has an upper flange that extends downwardly from the upper ridge, and the lower ridge has a lower flange that extends upwardly from the lower ridge, such that each of the plurality of plates are prevented from falling forward out of the plate frame after being mounted laterally.

14. The toy car storage device of claim 10, the plurality of plates each include indicia that is visible when the plates are mounted in the plate receiving space.

15. The toy car storage device of claim 14, wherein the indicia is in the form of letters.

16. The toy car storage device of claim 14, wherein the indicia is engraved onto each of the plurality of plates.

17. The toy car storage device of claim 10, wherein the upper and lower ridges are spaced a distance that is approximately equal to or greater than the height of each of the plurality of plates.

18. The toy car storage device of claim 10, further comprising a back panel attached to the storage body that provides a backing for the plurality of storage recesses.

* * * * *